United States Patent [19]

Peterson, Jr.

[11] 4,043,514

[45] Aug. 23, 1977

[54] COMMINUTION DEVICE

[75] Inventor: Russell I. Peterson, Jr., Bay City, Mich.

[73] Assignee: Conair, Inc., Franklin, Pa.

[21] Appl. No.: 667,400

[22] Filed: Mar. 16, 1976

[51] Int. Cl.[2] ..... B02C 23/04

[52] U.S. Cl. ..... 241/36; 241/37.5; 241/285 B

[58] Field of Search ..... 241/36, 37.5, 73, 222, 241/285 B

[56] References Cited

U.S. PATENT DOCUMENTS

| | | | |
|---|---|---|---|
| 2,830,770 | 4/1958 | De Luca | 241/73 |
| 2,880,942 | 4/1959 | Hall | 241/36 UX |
| 2,982,483 | 5/1961 | Heinemans | 241/36 X |
| 3,182,917 | 5/1965 | Tamny et al. | 241/36 |
| 3,313,493 | 4/1967 | Scott et al. | 241/36 |
| 3,360,204 | 12/1967 | Merges et al. | 241/73 |
| 3,756,519 | 4/1973 | Reynolds et al. | 241/285 B X |

*Primary Examiner*—Roy Lake
*Assistant Examiner*—Howard N. Goldberg

[57] ABSTRACT

A Comminution Device in which the comminution structure has its upper portion enclosed during operation within a movable cover which cover controls the actuation of the flywheel to prevent rotation of the flywheel when opening the cover is initiated.

9 Claims, 5 Drawing Figures

COMMINUTION DEVICE

CROSS-REFERENCE TO RELATED APPLICATIONS

Ser. No. 668,062 and Ser. No. 667,301 filed concurrently herewith each entitled Comminution Device.

Comminution devices are used in various industries with one particularly well known prior use being in the plastics industry in which such devices are commonly referred to as plastics granulators. Plastics granulators are commonly used to fragmatize pieces or sections of plastic material which result from various plastic forming operations. Such plastic pieces are of a wide variety of size, thickness and shape so that during their fragmentation the amount and orientation of such material with respect to the rotating cutter means varies during the fragmentation process. Due to such irregularities in and hardness of such plastic pieces the energy per blow required to produce fragmentation of all pieces varies substantially which has resulted in frequent stalling of prior comminution devices or required a large horsepower drive. Prior granulators may be of various well known forms such as shown in U.S. Pat. Nos. 2,830,770; 3,419,223; 3,756,519; 3,790,093; 2,381,775, and my prior patent 3,643,880.

Generally prior granulators have employed a flywheel to rotatively drive the power input shaft of the rotor member of the comminution structure. Since the rotating member of the comminution structure can become stuck during operation it is necessary to provide reasonably easy access to the comminution structure during operation of the granulator to permit removal of the plastic piece preventing the rotor member from rotating. When the rotor member is stuck the access provided does not create any problem, however, since access is provided it is possible in other instances to obtain access to the comminution structure prior to the flywheel giving up all its energy. The structure of this invention provides a device which will not permit the operator to obtain hand access to the rotor member prior to the flywheel stopping.

Accordingly, one subject of this invention is to provide a new and improved comminution device having a flywheel the actuation of which is controlled by a cover for the comminution structure.

Another object of this invention is to provide a new and improved comminution device having cover controlled electrical and mechanical means for controlling the braking of the flywheel of the device.

A more specific object of this invention is to provide a new and improved comminution device having a brake shoe engagable with the rim of the flywheel of such device to cause substantially instantaneous stopping of the flywheel under selected conditions.

These and other objects and advantages of the present invention will become more readily apparent upon a reading of the following description and drawings of the presently preferred embodiment thereof in which.

Figure 1:
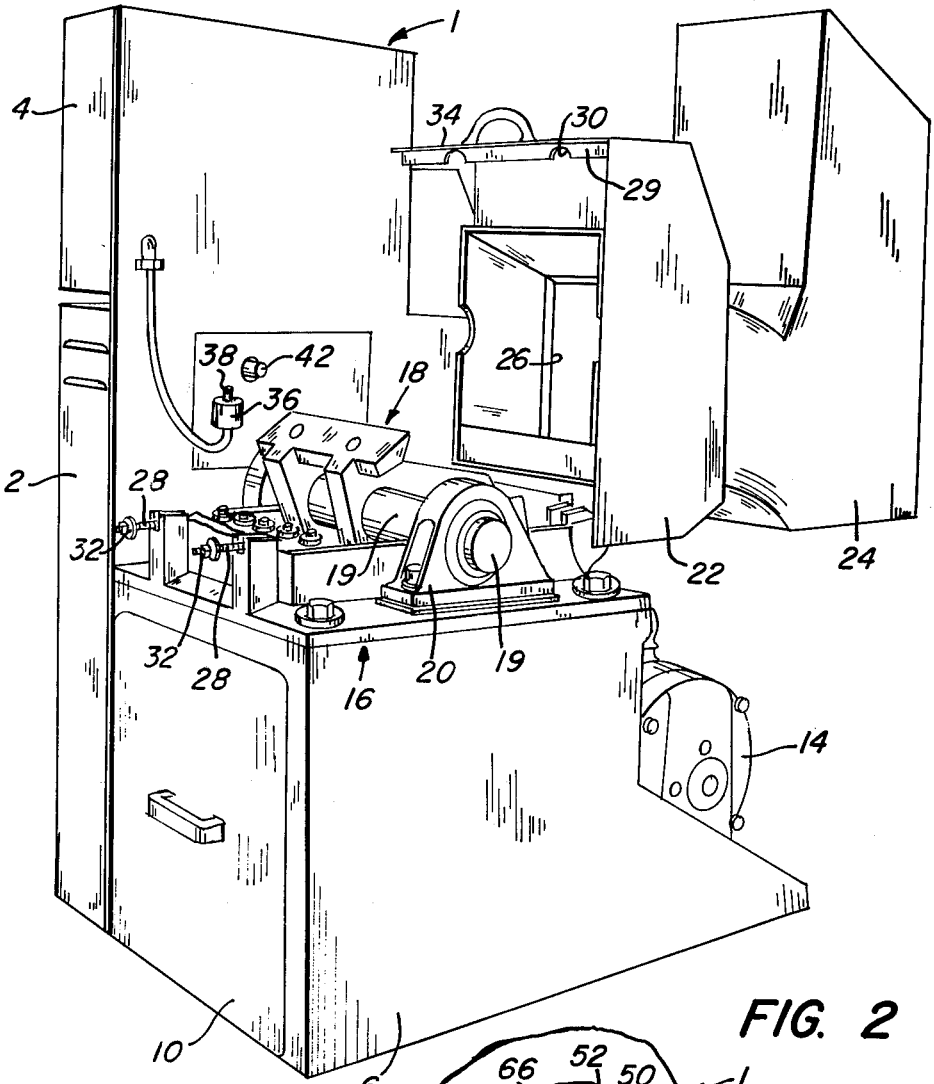
FIG. 1 is a perspective view of a comminution device constructed in accordance with the principles of this invention with the feed hopper thereof in the open position.

As shown in FIG. 1 the comminution device of this invention comprises a formed housing 1 having a vertically extending flywheel housing portion 2 at one side thereof, an electrical control receiving box 4 extending above the flywheel housing portion 2 and a hollow base portion 6 located to the side of the flywheel housing portion 2. Housing 1 is formed from any suitable material having sufficient structural strength such as steel with base portion 6 having an upper inwardly extending peripheral flange (not shown) to which a comminution structure is suitably rigidly secured. Base portion 6 is provided with a slidable drawer 10 for receiving comminuted material therein and to permit access thereto. Base portion 6 has a vertically extending rearward wall having a suitable electrical motor 14 suitably rigidly secured to the lower portion thereof.

The comminution structure consists of a formed stationary bed member 16 and a rotor member 18 having a central elongated shaft 19 supported for rotation by the bed member 16 in any suitable manner such as by axially spaced bearings 20 carried by the bed member 16. For the purpose of this invention the comminution structure may be of any suitable structure; however, the preferred form of the comminution structure is more particularly shown and described in my copending application Ser. No. 668,062 and the disclosure thereof is incorporated herein for the purpose of disclosure of this application. A cover 22 for enclosing the upper portion of the comminution structure is suitably hingedly connected to the rearward portion of the bed member 16. A formed hollow feed hopper 24 is suitably rigidly secured to the cover 22 and the cover 22 has an opening 26 in the upper portion thereof to permit material to be inserted through feed hopper 24 into the comminution structure. For the purposes of this invention the feed hopper 24 is secured to the cover 22 in any suitable manner and the bed member 16 is secured to the flange of the base portion 6 in any suitable manner; however, the preferred form for supporting such member is more particularly shown and described in my copending application Ser. No. 667,301 and the disclosure thereof is incorporated herein for the purposes of the disclosure of this application. The feed hopper 24 may be of any suitable form and material to permit proper feeding of material to the comminution structure.

The front portion of bed member 16 pivotably and captively supports a pair of elongated threaded access bolts 28 which are laterally spaced from each other and which are pivotably supported by bed member 16 and swingable from a horizontal position into a vertical position to permit access bolts 28 to enter into spaced open ended receiving slots 30 extending inwardly in a strap portion 29 rigidly carried by the cover 22. With bolts 28 so located within slots 30 suitable nuts 32 are tightened against the strap portion 29 whereby the cover 22 is properly securable in tight relationship to the bed structure 16. Cover 22 carries a suitable hinged flap 34 having an exterior handle to permit access to the nuts 32. Strap portion 29 is carried by cover 22 adjacent the lower edge of flap 34, when cover 22 is in the closed position, to be aligned with and receive the bolts 28 when bolts 28 are in their upwardly extending position. A normally open electrical switch 36 is carried by the flywheel housing portion 2 having a suitable contact closing means, as illustrated a plunger 38, located so that the motor 14 is only electrically energizable when the cover 22 is properly secured to the bed member 16. A suitable armored cable electrically connects the switch 36 to suitable electrical controls (not shown) in the control box 4.

Figure 5:
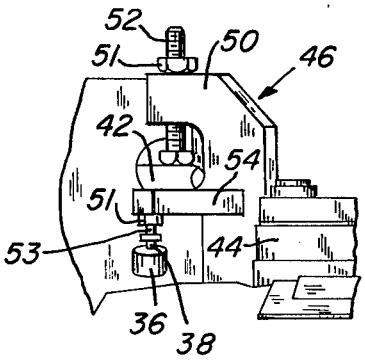
FIG. 5 is an enlarged perspective view of the actuator assembly as utilized in the device as shown in FIG. 1.

A suitable opening is provided in the flywheel housing portion 2 through which the free end of a brake shaft 42 of a brake assembly 48 extends. Cover 22 has a flange 44 (see FIG. 5), extending upwardly and around the opening 26, which is spaced inwardly of the housing portion 2 to which the lower end of the feed hopper 24 is secured so that a space is provided between the flywheel housing portion 2 and the lower end of the feed hopper 24 and cover 22. A switch 36 is located in and the free end of shaft 42 extends into the space between feed hopper 24 and housing portion 2. A formed switch and brake actuator 46 is rigidly carried by the cover 22 outwardly adjacent the flange 44 which extends into the space between hopper 24 and housing portion 2 to actuate the switch 36 and engage the end of the brake shaft 42. Actuator 46 is of any suitable form which as shown is somewhat in the form of a FIG. 7 with the upper arm 50 extending towards the housing portion 2. Upper arm 50 threadedly receives a suitable inverted threaded bolt 52 so that the head portion of bolt 52 engages the upper surface of shaft 42 to force the shaft 42 downwardly when cover 22 is properly closed. A side arm 54 rigidly carried by the upwardly extending portion or stem of actuator 46 extends towards the housing portion 2 which threadedly receives a suitable inverted bolt 53 which engages the plunger 38 to close switch 36 when the cover 22 is properly closed. Bolts 52 and 53 are axially adjustable to provide for proper engagement of shaft 42 and plunger 38 and suitable locking nuts 51 are also provided on bolts 52 and 53.

Figure 3:
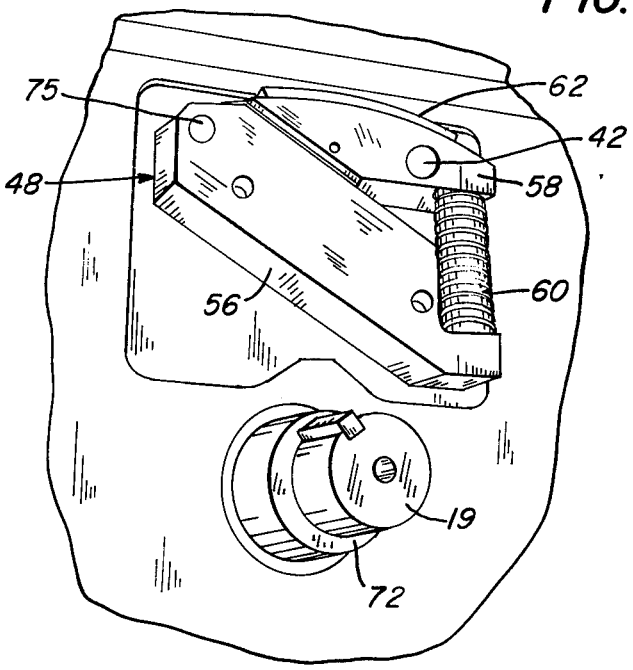
FIG. 3 is a perspective view of the brake assembly for the flywheel as located within the housing as shown in FIG. 1.

As shown in FIG. 3 the brake assembly 48 comprises a formed block 56 suitably rigidly secured to the flywheel housing portion 2 and a block 58 which is pivotably secured to the block member 56 and is biased outwardly from block member 56 by a spring 60 which spring 60 is shown in FIG. 3 in its open position. Pivot block member 56 has an upper arcuate surface to which a brake shoe 62 is suitably rigidly secured. Brake shoe 62 is engagable with the inner circumferential rim surface 63 of the outer rim portion 64 of a flywheel 66 for the purpose of stopping the rotation of the flywheel 66. The inner rim surface 63 engaged by the shoe 62 is not illustrated, however, the inner rim surface 63 is identical to the outer rim surface 63 shown as is known in flywheel construction. Accordingly, the brake shoe 62 is of an arcuate contour and width to obtain the maximum frictional engagement with the inner rim surface 63 and block member 56 has an upper arcuate surface to provide proper support for the brake shoe 62. For the purpose of this invention a standard industrial brake shoe is satisfactory for shoe 62.

As shown in FIG. 3 the rotor shaft 19 extends through the sidewall of the flywheel housing portion 2 and is provided with a suitable keyway structure cooperable with a central hub portion 68 of flywheel 66 whereby 66 rotatively drives rotor shaft 19. The outer surface of the rim portion 64 is suitably formed to receive suitable drive belts 70 which belts 70 are driven by a suitable drive pulley (not shown) on the output shaft of motor 14 as is well known in the art. The rotor shaft 19 has a shoulder 72 which extends radially outwardly at the inner end of the keyway structure which engages the hub portion 68 of flywheel 66 to position the flywheel 66 with reference to the vertically extending inner wall of the flywheel housing portion 2. With flywheel 66 so located the brake assembly 48 is located between the vertically extending wall of the housing portion 2 and the centrally located arms 74 of the flywheel 66 whereby brake assembly 48 does not interfere with the rotation of flywheel 66 other than when the brake shoe 62 engages the inner rim surface 63. The flywheel 66 is driven by motor 14 through belt 70 to obtain the desired rotation of the rotor member 18.

Figure 4:
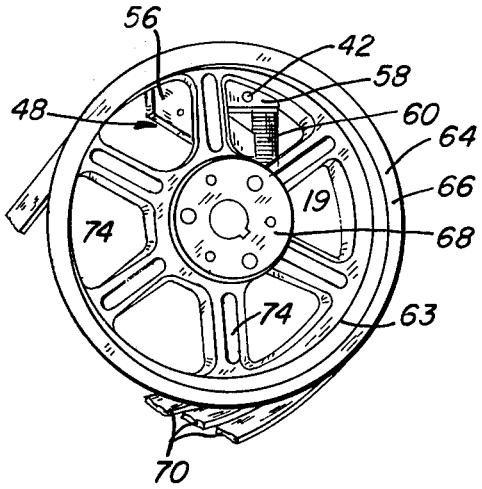
FIG. 4 is a perspective view of the flywheel as located within the housing of the device as shown in FIG. 1.

When flywheel 66 is being rotatively driven by motor 14 the brake shoe 62 must clear the inner rim surface 63 of flywheel 66 and accordingly brake shaft 42 is rigidly secured to pivot block member 58 so that the force required to close cover 22 by the anchoring of access bolts 28 is transferred through cover 22 to the actuator 46 and, by the engagement of bolt 52 with brake shaft 42, overcomes the bias of spring 60 to force the block member 56 inwardly away from the inner rim surface 63 to close the spring 60 as shown in FIG. 4. Conversely when the cover 22 is loosened the bolt 52 moves away from shaft 42 and spring 60 biases the block member 58 upwardly, as shown in FIG. 3, towards the inner rim surface 62 so that brake shoe 62 engages the inner rim surface 63 to stop the rotation of flywheel 66. Accordingly to obtain the best utilization of the forces for so actuating block member 58 one end of the block member 58 is pivotably supported by block member 56 by a suitable pivot connection 75, the spring 60 engages the under surface of block member 58 at the end of block member 58 opposite pivot connection 75 and extends vertically therebetween, and brake shaft 42 is received within block member 58 closely adjacent the upper end of spring 60 intermediate the spring 60 and the pivot connection 75. Obviously other mechanical arrangements can be employed to move the brake shoe 62; however, the specific structure shown and described is presently preferred due to its mechanical efficiency, compactness and simplicity of components.

When cover 22 is in the open position of FIG. 1 the motor 14 is deenergized and the flywheel 66 is restrained by the brake assembly 48. As described upon closing the cover 22 the actuator 46 releases the flywheel 66 from the brake assembly 48 and permits electrical energization of motor 14 by the closing of switch 36. The switch 36 is preferably an electrical interlock independent of the normal electrical control of the motor 14.

By adjusting bolts 52 and 53 a timed sequence between the release of brake shoe 62 and the closing of switch 36 can be obtained to insure that brake shoe 62 is properly clear of the rim surface 63 prior to permitting energization of the motor 14 by the switch 36, i.e. the shaft 42 is moved the proper distance to cause shoe 62 to clear the rim surface 63 prior to bolt 53 engaging the plunger 38. Conversely, upon release of cover 22 the motor 14 is deenergized to permit the flywheel 66 to decelerate prior to being engaged by the brake shoe 62 to minimize the load applied to brake shoe 62.

Figure 2:
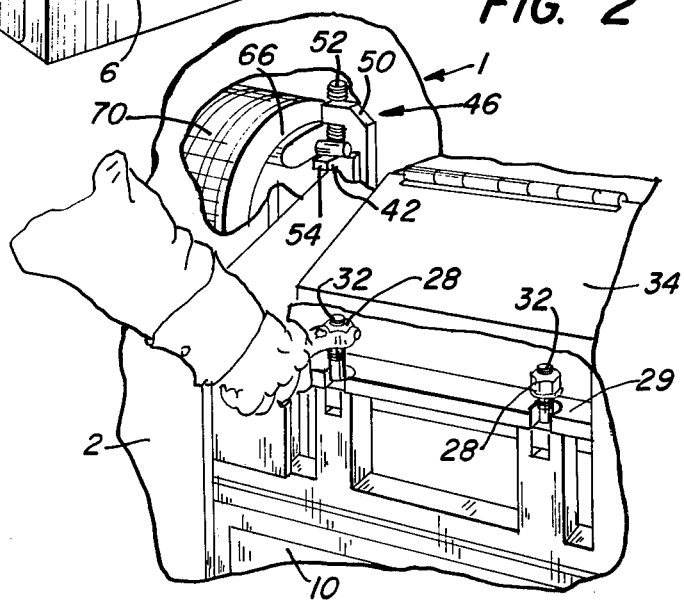
FIG. 2 is a perspective view of the central portion of the device shown in FIG. 1 with a portion of the front flap removed.

As is well known rotating flywheels when uncoupled from their drive have a flywheel effect (i.e. inertia) whereby their rotation continues after such uncoupling. Accordingly, the bolts 28 and nuts 32 for cover 22 provide a period of time before the cover 22 can be released from the bed member 16. As shown in FIG. 2 an operator lifts flap 34 to obtain access to bolts 28 and must use a suitable wrench means to release the nuts 32 from bolts 28 which time period permits the flywheel 66 to stop prior to the operator being able to move the cover 22 away from the rotor 18. Obviously other time delay means can be provided to insure that the operator cannot remove the cover 22 prior to the stopping of the flywheel 66; however, the described structure is preferred due to its simplicity, strength and the fact that an ordinary shop tool is all that is required to release or secure the cover 22. Thus bolts 52 and 53 permit, when closing, the switch 38 to be closed after shaft 42 has been moved to release the shoe 62 from the rim surface 63 and, during opening, permit the switch 38 to be opened prior to the brake shoe 62 engaging the rim surface 63.

Although I have described a preferred embodiment of my invention in accordance with the Patent Statutes and indicated some modifications that may be made thereto, I am aware that other modifications may be made without departing from the scope of my invention by one skilled in the art and accordingly the invention is to be interpreted in accordance with the scope of the appended claims.

What is claimed is:

1. A comminution device comprising: a housing member, a comminution structure consisting of a stationary member and a rotatable knife means, said comminution structure being supported by said housing member with said comminution structure having an upwardly open extent, a rotatable flywheel supported by said housing and coupled to said rotatable knife means to cause rotation thereof upon rotation of said flywheel, enclosure means movably supported by one of said members for selectively enclosing said open extent of said comminution structure, means supported by said housing member having a movable portion selectively engageable with said flywheel for applying a motion restraining force to said flywheel, and said enclosure means being selectively movable into and out of engagement with said movable portion to control the application of said motion restraining force to said flywheel.

2. A comminution device as specified in claim 1 wherein said enclosure means engages said movable portion to move said movable portion out of engagement with said flywheel.

3. A comminution device as set forth in claim 1 wherein said movable portion is biased towards engagement with said flywheel and said enclosure means engages said movable portion to overcome such bias when said open extent is enclosed.

4. A comminution device as specified in claim 3 wherein said enclosure includes means to vary the force applied to said movable portion to overcome such bias.

5. A comminution device as set forth in claim 1 wherein said flywheel has a rim portion and said movable portion is biased towards said rim portion with an outer surface thereof being engageable with an inner surface on said rim portion.

6. A comminution device as set forth in claim 5 wherein said outer surface is defined by an arcuate brake shoe carried by said movable portion.

7. A comminution device as specified in claim 1 wherein mechanical means secure said enclosure means to avoid stationary member when said open extent is enclosed and which mechanical means require releasing before said open extent can be uncovered by moving said enclosure.

8. A comminution device as specified in claim 1 wherein said flywheel is driven by an electrically energized drive, said housing carries switch means for controlling the electrical energization of said drive, and means carried by said enclosure to selectively actuate said switch means.

9. A comminution device as specified in claim 8 wherein said switch means is actuated in timed relationship with respect to said engagement of said enclosure with said movable portion.

* * * * *